US011417304B2

(12) United States Patent
Shemesh

(10) Patent No.: US 11,417,304 B2
(45) Date of Patent: Aug. 16, 2022

(54) ELECTRONIC PERCUSSION INSTRUMENT

(71) Applicant: Guy Shemesh, Haifa (IL)

(72) Inventor: Guy Shemesh, Haifa (IL)

(73) Assignee: Guy Shemesh, Haifa (IL)

( * ) Notice: Subject to any disclaimer, the term of this patent is extended or adjusted under 35 U.S.C. 154(b) by 141 days.

(21) Appl. No.: 16/849,971

(22) Filed: Apr. 15, 2020

(65) Prior Publication Data

US 2020/0327872 A1 Oct. 15, 2020

Related U.S. Application Data

(60) Provisional application No. 62/833,980, filed on Apr. 15, 2019.

(51) Int. Cl.

| | |
|---|---|
| ***G10H 3/14*** | (2006.01) |
| ***G10H 1/06*** | (2006.01) |
| ***G10H 1/32*** | (2006.01) |
| ***G10D 13/02*** | (2020.01) |

(52) U.S. Cl.

CPC ..... *G10H 3/146* (2013.01); *G10D 13/02* (2013.01); *G10H 1/06* (2013.01); *G10H 1/32* (2013.01); *G10H 3/143* (2013.01); *G10H 2220/531* (2013.01)

(58) Field of Classification Search

CPC ..... G10H 3/146; G10H 1/06; G10H 3/143; G10H 2220/531; G10D 13/02

USPC ..... 84/723

See application file for complete search history.

(56) References Cited

U.S. PATENT DOCUMENTS

| | | | | |
|---|---|---|---|---|
| 6,753,467 | B2 * | 6/2004 | Tanaka | G10H 3/146 84/723 |
| 7,038,117 | B2 * | 5/2006 | Yoshino | G10H 3/146 84/723 |
| 8,183,450 | B2 * | 5/2012 | Yoshino | G10D 13/16 84/411 R |
| 8,563,843 | B1 * | 10/2013 | Shemesh | G10H 3/146 84/723 |
| 8,816,181 | B2 * | 8/2014 | Shemesh | G10H 7/00 84/615 |
| 8,940,991 | B2 * | 1/2015 | Shemesh | G10H 3/146 84/615 |

(Continued)

FOREIGN PATENT DOCUMENTS

| | | | | |
|---|---|---|---|---|
| CN | 210667768 U | * | 6/2020 | |
| EP | 3291223 B1 | * | 3/2019 | G10H 1/32 |

(Continued)

*Primary Examiner* — Christina M Schreiber

(57) ABSTRACT

An electronic percussion instrument includes a body having a top opening and an internal support area, and a drumhead having a striking surface and a drumhead bottom surface opposite thereto, the drumhead is stretched over the top opening of the body and is configured to receive a percussion strike thereon, and at least one peripheral sensor disposed on the internal support area of the body, and at least one rising element configured to be flexible and disposed on the internal support area of the body, and a peripheral carrier, adapted to receiving vibrations from the periphery of the drumhead, the peripheral carrier is supported by the at least one rising element such that a pressing force is formed for setting a top circumferential edge of the peripheral carrier in contact with the drumhead bottom surface.

21 Claims, 7 Drawing Sheets

(56) References Cited

U.S. PATENT DOCUMENTS

| | | | | |
|---|---|---|---|---|
| 9,947,307 | B2 * | 4/2018 | Takasaki | G10D 13/26 |
| 2004/0159223 | A1 * | 8/2004 | Kiyono | A63F 13/214 84/723 |
| 2006/0219092 | A1 * | 10/2006 | Mishima | G10H 3/06 84/724 |
| 2009/0229450 | A1 * | 9/2009 | Hashimoto | G10H 3/146 84/723 |
| 2013/0125735 | A1 * | 5/2013 | Mori | G10H 3/146 84/723 |
| 2014/0020547 | A1 * | 1/2014 | Shemesh | G10H 3/146 84/626 |
| 2014/0020548 | A1 * | 1/2014 | Shemesh | G10H 7/00 84/626 |
| 2014/0208926 | A1 * | 7/2014 | Shepherd | G10D 13/10 84/730 |
| 2014/0216234 | A1 * | 8/2014 | Wei | G10H 1/32 84/723 |
| 2019/0266989 | A1 * | 8/2019 | Yoshino | G10D 13/02 |
| 2020/0312285 | A1 * | 10/2020 | Shemesh | G10D 13/065 |
| 2020/0327872 | A1 * | 10/2020 | Shemesh | G10H 3/143 |

FOREIGN PATENT DOCUMENTS

| | | | | |
|---|---|---|---|---|
| GB | 2599670 | A * | 4/2022 | G10D 13/02 |
| JP | 2015203869 | A * | 11/2015 | G10D 13/024 |

* cited by examiner

ELECTRONIC PERCUSSION INSTRUMENT

CROSS-REFERENCE TO RELATED APPLICATIONS

This application claims the benefit of U.S. Provisional Application No. 62/833,980, filed Apr. 15, 2019.

BACKGROUND OF THE INVENTION

1. Field of the Invention

This invention relates to electronic percussion instruments such as electronic drums and cymbals, and more specifically to electronic percussion instruments that faithfully detect the location of an impinging percussion stroke and have an improved design for manufacturing.

2. Description of Related Art

Generally, electronic percussion instruments include a drumhead, typically a mesh type, which is stretched over a shell, a generally tubular body, using a metallic rim extending over the circumference of a drumhead and fastened to the shell using the so called lugs attached to the shell. A generally bowl shaped part is disposed in the interior of the shell, to allow for mounting of sensors, typically piezoelectric type, for conversion vibration energy induced by a percussion stroke into electronic signal.

For example, U.S. Pat. Nos. 9,947,307, 8,183,450, 7,038,117, disclose such interior bowl shaped part for mounting sensors. However, these inventions do not handle finding the position of percussion strokes with high accuracy. Furthermore, these inventions require a separate drum shell with additional interior parts, contributing to the increased cost of the product.

In contrary, my U.S. Pat. Nos. 8,563,843, 8,816,181, 8,940,991 disclose an arrangement for detecting with high accuracy the position of a percussion stroke based on time of arrival of a vibration to a center and peripheral sensors. In particular, the necessary plurality of sensors placed to detect vibrations on the periphery of the drumhead are disclosed and further disclosed is the so called peripheral carrier which conducts and averages vibrations from the periphery of the drumhead to the sensors. However, the inventions require a drum shell which adds to the cost of the product. Furthermore the assembly contains multiple parts and the electrical connection of the plurality of sensors is labor intensive, further increasing the cost of manufacturing the product.

Therefore, what is clearly needed is an instrument having a mechanical and electrical assembly arrangements such that, despite the plurality of sensors needed for faithful positional detection, manufacturing labor and overall production cost is kept reasonable, allowing for a lower product cost for the end user.

BRIEF SUMMARY OF THE INVENTION

In one embodiment of the invention an electronic percussion instrument is provided, comprising a body having a top opening and an internal support area, a drumhead having a striking surface and a drumhead bottom surface opposite thereto, the drumhead is stretched over the top opening of the body and is configured to receive a percussion strike thereon, at least one peripheral sensor disposed on the internal support area of the body, at least one rising element configured to be flexible and disposed on the internal support area of the body, and a peripheral carrier, adapted to receiving vibrations from the periphery of the drumhead, the peripheral carrier is supported by the at least one rising element such that a pressing force is formed for setting a top circumferential edge of the peripheral carrier in contact with the drumhead bottom surface, wherein the at least one peripheral sensor is coupled to the at least one rising element such that vibrations received on the striking surface by a percussion strike are transmitted to the at least one peripheral sensor by the peripheral carrier and the at least one rising element.

Also in one embodiment the at least one rising element is made of elastomeric material, adapted to resume its original shape when a deforming force is removed.

In another aspect of the invention An electronic percussion instrument is provided, comprising a body having a top opening and an internal support area, and a drumhead having a striking surface and a drumhead bottom surface opposite thereto, the drumhead is stretched over the top opening of the body and is configured to receive a percussion strike thereon, and a peripheral carrier, supported interior to the body and having a circumferential top edge configured to be in contact with the drumhead bottom surface for receiving vibrations from the periphery of the drumhead, and at least one peripheral sensor disposed on the internal support area of the body and coupled to the peripheral carrier for converting vibrations therefrom to an electronic signal, and at least one flexible circuit board, disposed in the internal support area of the body and electrically coupled to the at least one peripheral sensor, wherein the at least one flexible circuit board is configured for reducing electrical wire connections to the at least one peripheral sensor, thereby reducing production labor.

In some embodiments the flexible circuit board is configured as a unified PCB produced as a single flat piece and having exposed conductor regions configured for electrical connection to the at least one peripheral sensor, the unified PCB is further configured to be in shape that allows bending thereof for attachment in the internal support area of the body and for reaching each of the peripheral sensors.

Also in some embodiments the flexible circuit board is comprising a peripheral PCB which is produced as a flat flexible piece having the shape of a strip but is curved while being supported on the internal support area of the body, wherein the length of the peripheral PCB in one dimension is made sufficiently long and wherein the peripheral PCB is having exposed conductors configured to be provided close to each of the peripheral sensors thereby allowing for electrical connection thereto.

Additionally, some embodiments further comprising at least one additional sensor PCB configured as a flexible circuit board having exposed conductor regions which are configured for electrical connection to the at least one peripheral sensor from one end and to the peripheral PCB on the other end.

Other embodiments further comprising wires for electrical connection of the at least one peripheral sensor to the peripheral PCB.

DETAILED DESCRIPTION

Illustrative embodiments of the invention which are meant to be descriptive and not limiting are described with reference to the accompanying figures.

Figure 1:
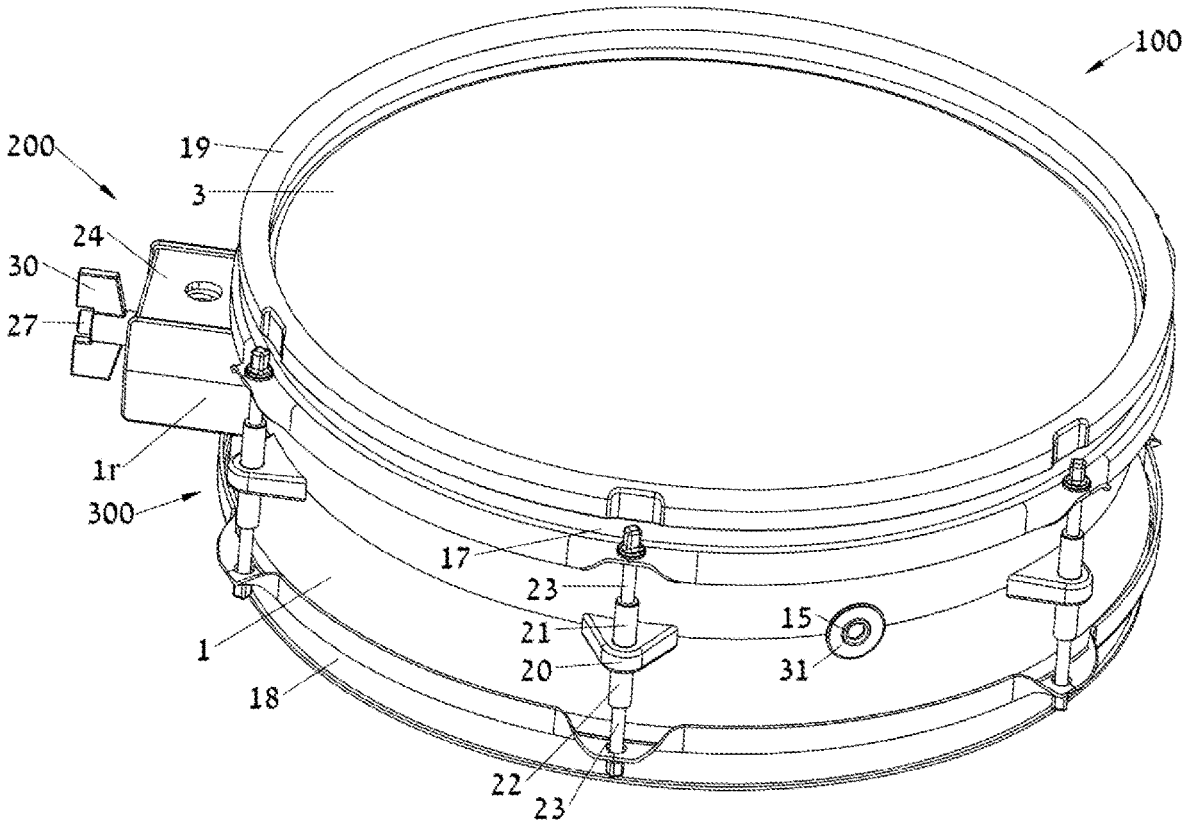
FIG. 1 is a perspective view of the electronic percussion instrument according to the first embodiment of the invention.
Figure 2B:
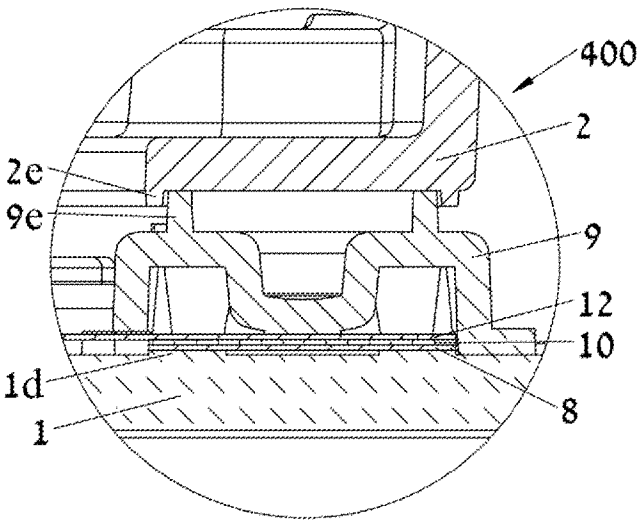
FIGS. 2B, 2C are detail views of FIG. 2A.
Figure 2C:
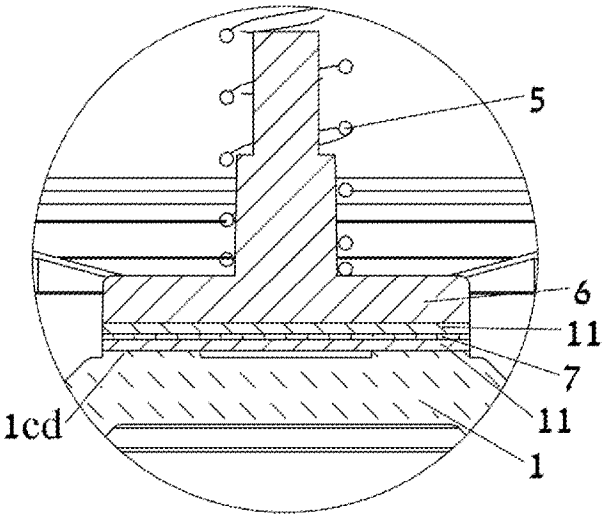
Figure 2A:
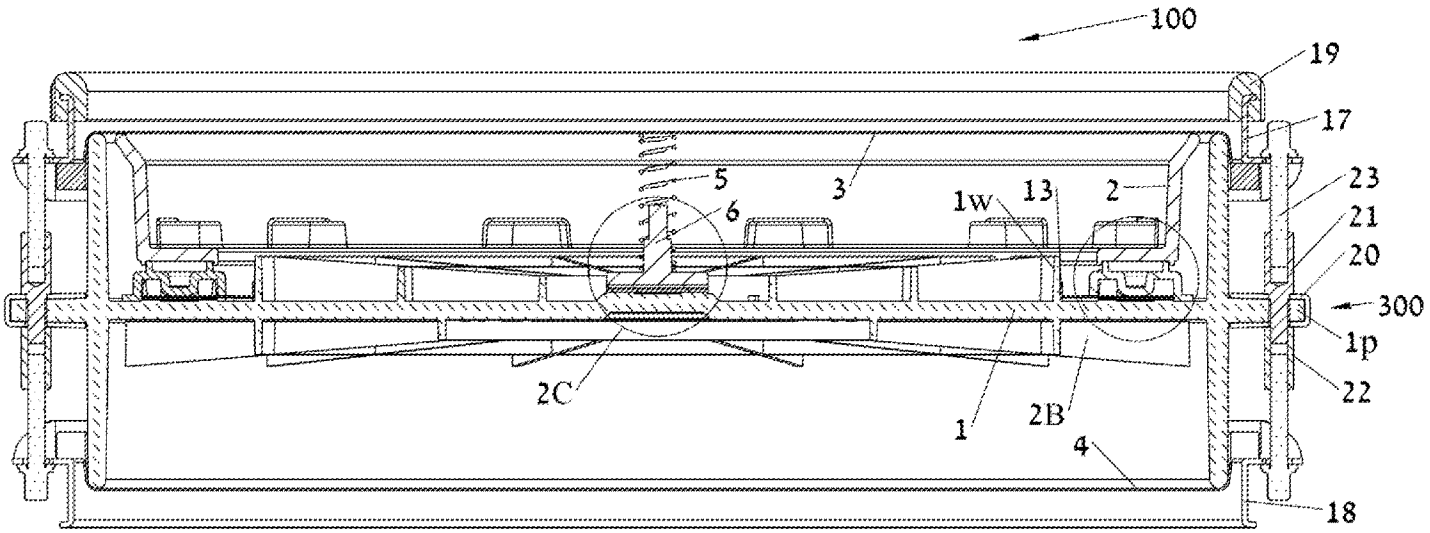
FIG. 2A is a cross-sectional view of the electronic percussion instrument according to the first embodiment of the invention.

FIG. 1 is a perspective view and FIG. 2A is a cross-sectional view of an electronic percussion instrument 100 according to the first embodiment of the invention. A body 1, typically made of plastic, has a structure serving multiple purposes that aid the manufacturing process, saving time and cost. Firstly, the body 1 has two ends where a top drumhead 3 and a bottom drumhead 4 are stretched over, thus the body serves also as a drum shell without requiring manufacturing a separate shell. A top rim 17 extends over and presses against the outer periphery of the top drumhead 3, so that the drumhead 3 is normally kept in a tensioned state and thus able to receive a percussion strike induced by a user of the instrument. In a similar fashion, a bottom rim 18 extends over and presses against the outer periphery of the bottom drumhead 4. A rim cover 19 made of elastic material such as rubber is covering the top rim 17 for reducing unwanted sounds when a percussionist is striking on the rim portion. The rim cover 19 has a ring shaped body with an internal groove fitted on the top end of the top rim 17. The top drumhead 3 is typically made of so called mesh, comprising one or more plies of a woven fibrous structure such that air can pass though the plies, therefore allowing percussion strikes impinging on the surface of the drumhead 3 to be a less noisy. The bottom drumhead 4 is not designed to be struck and may be either mesh type or a traditional drumhead made of plastic film such as mylar™ (PET). In the preferred embodiment of the present invention the bottom drumhead 4 is made of plastic film to save cost. A main connector 15 is disposed for connection the electronic percussion instrument 100 to an external computing device, or 'sound module'. The main connector 15 is positioned such that only its opening configured for receiving an external mating connecter (not shown) is slightly protruding through a hole made in the body 1 on an outer surface thereof. An optional hole cover 31 having the form of disc shape, is covering the hole made in the body 1 for aesthetic purposes such that the main connectors opening protrudes slightly through the center of the disc to allow a connection to a mating external connector. Not shown in the FIGS. is a thin covering ply that may extend through the external circumferential surface of the body 1, for aesthetic purposes. The thin covering ply has cutouts made so to allow protruding elements of body 1 to pass through.

Figure 3:
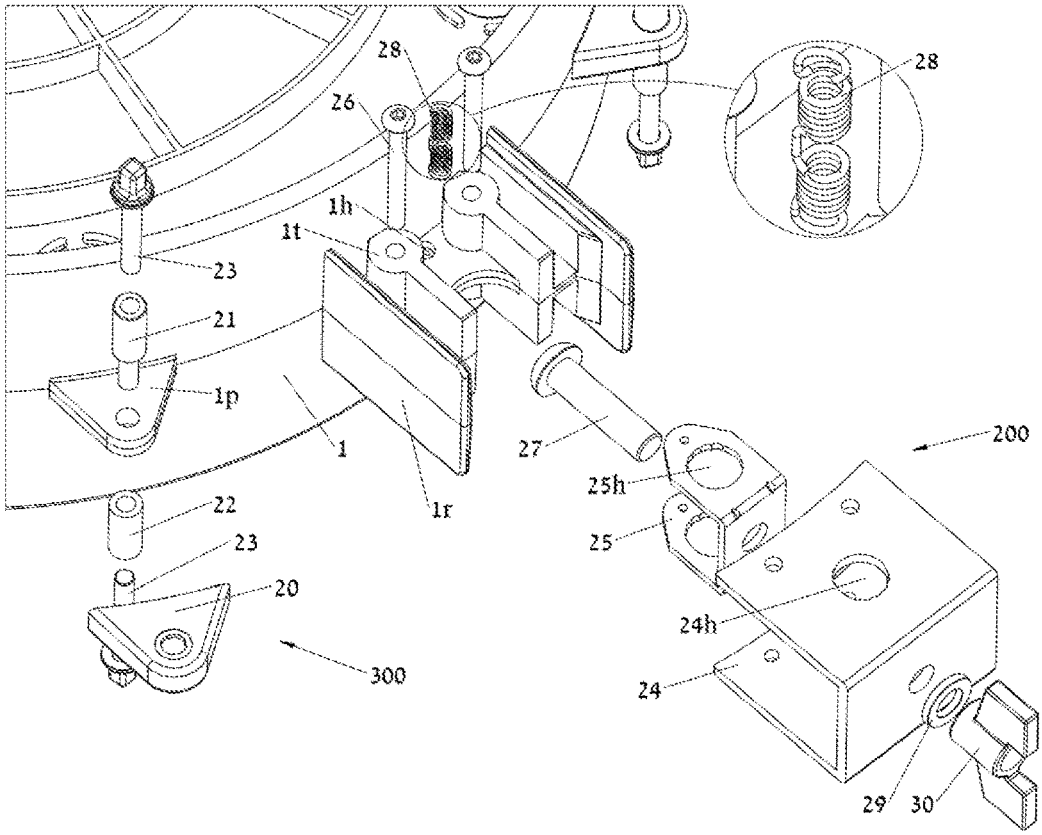
FIG. 3 is an exploded partial view of the electronic percussion instrument according to the first embodiment, detailing the bracket and lug assembly.

Embodiments of the present invention also disclose a lug assembly 300 which has the advantage of eliminating secondary operations typically done on drum shells, such as drilling holes for fastening elements to the shell. In addition to FIG. 2A, the lug assembly is also shown in FIG. 3 in an exploded partial view of the electronic percussion instrument 100. The body 1 has protrusions 1*p* located along its periphery, extending in a direction away from the center of the body 1. The protrusion 1*p* shown in the accompanying illustrative embodiments has a generally triangular shape and is covered by a lug 20 which is hollow and generally similar in shape so that the protrusion 1*p* is fitted into the interior of the lug 20. The protrusion 1*p* has a hole and the lug 20 has two holes on its top and bottom. A lug top fastener 21, having a male thread on one side and a female thread on the other side, is placed such that the male thread is inserted into the holes of the protrusions 1*p* and the lug 20, thus aligning the holes to be on the same axis and locking the lug 20 in position on the protrusion 1*p*. Furthermore, in an embodiment of the invention the lug top fastener 21 and the lug 20 are manufactured with some asymmetry so as to stop rotation of the lug top fastener 21 in the bore of the protrusion 1*p*. A lug bottom fastener 22, having a tubular shape and an internal threading on its bore, is bolted into the male thread of the lug top fastener 21, securing the lug assembly 300 into position on the protrusion 1*p* of the body 1. A thread locking fluid may be added on the male thread of the lug top fastener 21 or on the female thread of the lug bottom fastener 22 to prevent loosening of the assembly. It is noted that in the preferred embodiment, the protrusions 1*p*, including their holes, are made automatically during injection molding of the body 1 and do not require any secondary operations such as drilling to the shell.

Referring back to FIGS. 1 and 2A, the size of the body 1 is selected such that the central axes of the holes of the protrusions 1*p* are aligned with center of the holes that are made into the circumference of the top rim 17 and the bottom rim 18. Drum bolts 23 are fitted into the holes of the top rim 17 and engaged into the threads of the lug top fasteners 21, forming a force on the periphery of top drumhead 3 in a direction towards the lug top fasteners 21, thus holding the top drumhead 3 in a tensioned state suitable for receiving a percussion strike. In similar fashion, drum bolts 23 are fitted into the holes of the bottom rim 18 and engaged into the threads of the lug bottom fasteners 22, forming a force on the periphery of bottom drumhead 4 in a direction towards the lug bottom fasteners 22, thus holding the bottom drumhead 4 in a tensioned state.

Therefore, in normal operational state of the electronic percussion instrument 100, the forces applied by the lug assembly 300 to hold the top drumhead 3 in a tensioned state are partially balanced against the opposing forces applied by the lug assembly 300 to hold the bottom drumhead 4 in a tensioned state. These forces are applied in opposite directions and are partially canceling each other, while the remaining force is held by the lug assembly 300 and in particular are transmitted to the protrusions 1*p* of the body 1 by the lugs 20. Generally, it is possible for the protrusions 1*p* to be made strong enough to hold the required tension, for example by the choice of raw material with high mechanical properties for production of the body 1, such as PC, POM or the like, and the raw material may optionally also have glass fibers added for strength. Furthermore, it is also possible to add steel inserts to the mold during injection molding process in the locations of the protrusions 1*p*. The steel inserts have generally the same shape of the protrusions 1*p* but are made slightly longer in the direction towards the center of the body 1. After the plastic resin is solidified in the mold, the previously inserted steel inserts become integrated into the body 1, greatly enhancing the strength of the protrusions 1*p*.

Figure 9A:
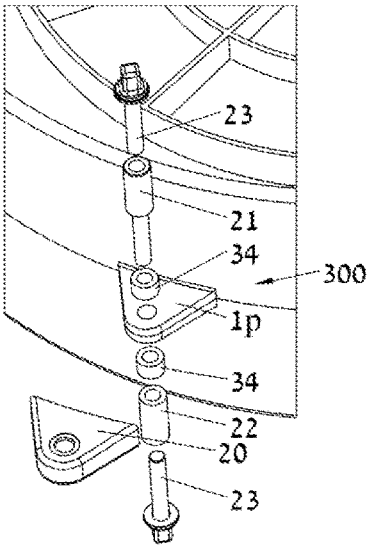
FIG. 9A is an exploded partial view of the lug assembly according to the second embodiment of the invention.
Figure 9B:
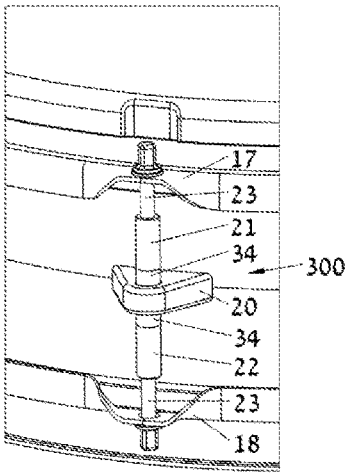
FIG. 9B is a perspective partial view of the lug assembly according to the second embodiment of the invention.
Figure 9C:
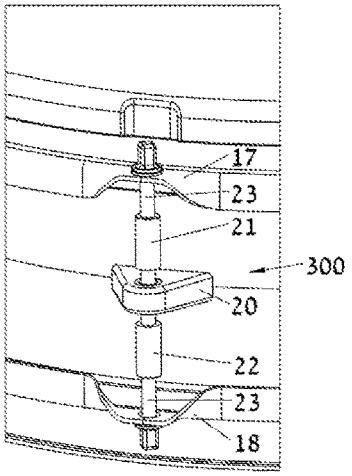
FIG. 9C is a perspective partial view of the lug assembly according to the third embodiment of the invention.

Nevertheless, the present invention also includes further embodiments as illustrated in FIGS. 9A-9C, where the forces exerted on the protrusions 1*p* are much reduced or even eliminated. FIG. 9A is an exploded partial view and FIG. 9B is a perspective partial view of the lug assembly 300 according to the second embodiment of the invention. In this embodiment a spacer 34 is added between the lug top fastener 21 and the lug 20 and another spacer 34 is added between the lug bottom fastener 22 and the lug 20. Compared to the first embodiment, the lug top fastener 21 has been made slightly longer to provide room for the two spacers 34. The spacers 34 have a hollow cylindrical shape and are preferably made from flexible material such as rubber or flexible PVC or the like. Therefore, the assembly comprising the two spacers 34 and the lugs top and bottom fasteners 21 and 22 is flexible to move to some degree allowable by the compression of the spacers. For example, when the pulling force applied on the lug top fastener 21 is larger than the pulling force applied on the lug bottom fastener 22, the lug top fastener 21 will move in a direction upwards towards the top drumhead 3, the attached lug bottom fastener 22 will also move upwards the same distance, compressing the spacer 34 that is disposed on the lower side between the lug 20 and the lug bottom fastener 22. In the same manner, when the pulling force is stronger towards the bottom drumhead 4, the spacer 34 on the upper side (disposed between the lug 20 and the lug top fastener 21) will compress. In this manner, the strong forces required for tensioning the top and bottom drumheads 3 and 4 have better ability to balance each other and are exerting less tension on the protrusions 1*p*.

Furthermore, FIG. 9C is a perspective partial view of the lug assembly 300 according to the third embodiment of the invention, where the forces exerted on the protrusions 1*p* are eliminated. According to the third embodiment the spacers 34 are non-existent, instead, there is a gap left between the lug top fastener 21 and the lug 20, and further, there is also a gap left between the lug bottom fastener 22 and the lug 20. The thread of the lug top fastener 21 is engaged into the thread in the bore of the lug bottom fastener 22, preferably with addition of thread locking fluid or the like to prevent loosening of the connection. The resulting structure of the lug top and bottom fasteners 21 and 22 is able to move freely upwards and downwards, sliding through the holes of the protrusion 1*p* and the lug 20. Therefore, any force applied towards the top drumhead 3 can only be balanced towards the force applied towards bottom drumhead 4, provided that a large enough gap is provided between the lug 20 and the lug top fastener 21 and between the lug 20 and the lug bottom fastener 22. Thus the protrusions 1*p* are left free from tension, relaxing the demanding requirements on the strength of the protrusions 1*p*.

To summarize, an electronic percussion instrument is provided, comprising a body 1 having a top opening, an internal support area 1*d*, 1*w*, 1*b* and a plurality of protrusions 1*p* spaced on a middle plane exterior thereof, the protrusions 1*p* further having a hole such that a fastening element can pass through, and a top drumhead 3 having a striking surface and a periphery, the top drumhead 3 is stretched over the top opening of the body 1 and is configured to receive a percussion strike thereon, and at least one sensor disposed on the internal support area of the body and coupled to the top drumhead for converting the vibrations induced by a percussion strike to an electronic signal, and a plurality of lugs 20, having a hollow shape with an opening on one side, the lugs are disposed over the protrusions 1*p* of the body 1 so as to cover them, and further having a top hole and a bottom hole which are configured to be aligned with the hole of the protrusions 1*p* so as to allow a fastening element to pass through the lug and the protrusion, and a top rim 17, configured as a circular hoop extending over the periphery of the top drumhead and having holes for receiving a fastening element, the holes are aligned about the same axis with the holes of the protrusions 1*p* and the holes of the lugs 20, and a plurality of lug top fasteners 21 having a male thread extending on one end and a female thread bored on other end opposite thereto, the lug top fasteners 21 are disposed such that the male thread is inserted through the top and bottom holes of the lug 20 and through the hole of the protrusion 1*p*, and a plurality of lug bottom fasteners 22 having a generally tubular shape having a female thread throughout the center hole of the tube, the lug bottom fasteners 22 are bolted over the male thread of the lug top fastener 21 so as to lock the lug top fastener 21 into position, thereby affixing the lugs 20 into position on the protrusions of the body, and a plurality of drum bolts 23, fitted into the holes of the top rim 17 and engaged into the threads of the lug top fasteners 21 so as to exert forces throughout the periphery of the top drumhead 3 in a direction towards the lug top fasteners 21, thereby holding the top drumhead 3 in a tensioned state suitable for receiving a percussion strike. Furthermore, a bottom drumhead 4 having a periphery is provided, the bottom drumhead 4 is stretched over a bottom opening of the body, and a bottom rim 18, configured as a circular hoop extending over the periphery of the bottom drumhead 4 and having holes for receiving a fastening element, the holes are aligned about the same axis with the threads of the lug bottom fasteners 22. A plurality of drum bolts 23 are fitted into the holes of the bottom rim 4 and engaged into the female threads of the lug bottom fasteners 22 so as to exert forces throughout the periphery of the bottom drumhead 4 in a direction towards the lug bottom fasteners 22, thereby holding the bottom drumhead 4 in a tensioned and having a reciprocal forces for balancing the load exerted on the body 1 by the lug top fasteners 21 and lug bottom fasteners 22.

Figure 4:
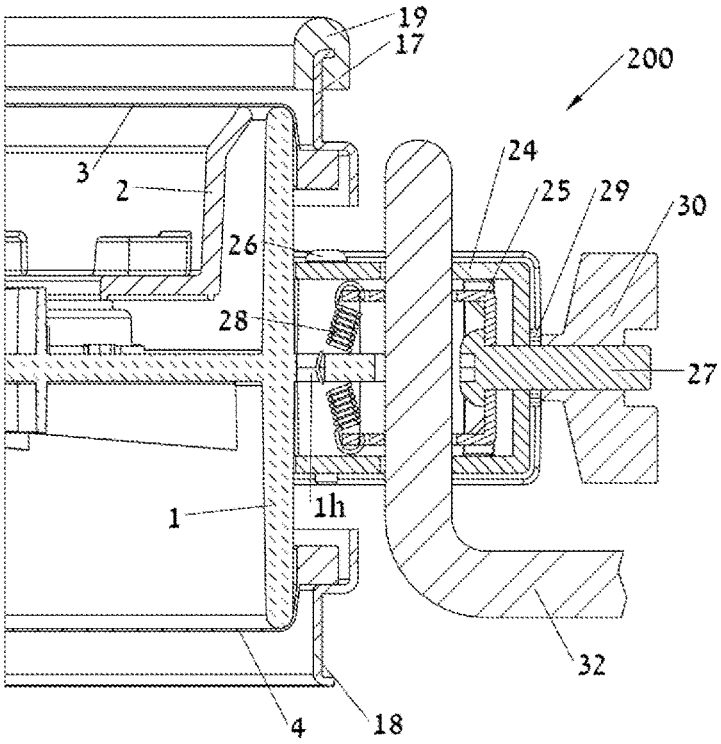
FIG. 4 is a cross-sectional partial view of the electronic percussion instrument according to the first embodiment of the invention, detailing the bracket assembly.

Next, referring to FIGS. 3-4, a bracket assembly 200 is described according to the first embodiment. In the illustrative figures, FIG. 3 is an exploded partial view detailing a bracket assembly 200 and FIG. 4 is a cross-sectional partial view also detailing the bracket assembly 200. An exemplary pole 32 is partially shown in FIG. 4 for the sake of illustration of how the bracket is attached to an external mounting device, however it should be noted that the pole 32 is a off the shelf device typically used in electronic and acoustic drum assemblies and is not a part of the present invention. First, the body 1 of the preferred embodiment has two ribs 1*r* extending outward from the periphery of the body 1. The two ribs 1*r* are generally parallel to each other and form two sides of the bracket assembly 200. Two tubes 1*t* are located between and adjacent to the two ribs 1*r*, each having a hole extending from one side of the tube to the other side without obstruction. The two tubes 1*t* are located close to the periphery of the body 1 and further have a rib extending from each of them in a direction away from the center of the body 1. Additionally, a single hole 1*h* is created on the middle between the ribs, the purpose of the tubes 1*t* and the hole 1*h* are explained hereinbelow. It should be emphasized that in the preferred embodiment, the ribs 1*r*, the tubes 1*t* and the hole 1*h* are all formed automatically during the injection molding process, and don't require any secondary operations.

Next, referring to FIGS. 3-4, a primary clevis 24 is introduced. The primary clevis 24 is a U-shaped part typically made of steel by conventional metalworking stamping processes. The primary clevis 24 has two pairs of holes, each pair is arranged such that during the assembly of the primary clevis 24 onto the body 1, the holes of each pair of the primary clevis 24 are aligned with the central axis of each of the tubes 1*t*. For each pair of the holes of the primary clevis, the hole on the top side is a regular hole while the hole on the bottom is threaded, suitable for fastening to an external bolt. A clevis bolt 26 is then inserted into the top hole of the primary clevis 24, through the hole of the tube 1*t* and into the threading of the bottom hole of the primary clevis 24, securing it to the body 1. The top and bottom ends of the tubes 1*t*, the ribs extending outwards from the tubes 1*t*, and additionally a step formed on the internal side of the ribs 1*r*, all form surfaces configured for increasing the contact area of the body 1 with the internal walls of the primary clevis 24. The two clevis bolts 26 are securing these surfaces to the walls of the primary clevis 24 thus firmly fastening the body 1 with the primary clevis 24.

Interior to the bracket assembly 200, a secondary clevis 25 is introduced. In the preferred embodiment, the secondary clevis 25 is a U-shaped part also made of steel by conventional metalworking stamping processes. On the central wall of the secondary clevis 25, there is a threaded hole on for engaging a bracket bolt 27. In other embodiments, the secondary clevis 25 does not have a thread; instead, it has a hole which the bracket bolt 27 passes and the two parts are permanently attached as one piece by means of welding or press fitting or the like. In either embodiment, the secondary clevis 25 and the bracket bolt 27 are joined together and operate as one piece. Next, the primary clevis 24 has a hole on its central wall from which the bracket bolt 27 passes through. A bracket washer 29 is fitted on bracket bolt 27 from the outside central surface of the primary clevis 24, followed by a butterfly nut 30 which is threaded onto the bracket bolt 27. The butterfly nut 30 is operated by the user of the electronic percussion instrument 100 during installation on a pole 32 or the disassembly thereof, and is hand operated without requiring any auxiliary tools to tighten (or loosen) the butterfly nut 30 onto the bracket bolt 27.

Furthermore, according the first embodiment detailed in FIGS. 3-4, a bracket spring 28 is disposed interior to the bracket assembly 200. The bracket spring 28 of the preferred embodiment has a shape similar to two compression springs joined on one side while their other side has a hook shaped ending. However, other shapes are possible as well. The bracket spring 28 is fitted into the hole 1*h* of body 1, while the hook like shape of the two ends of the bracket spring 28 are fitted into two holes made in the secondary clevis 25.

Thus the secondary clevis 25 is held into position from two directions. On one side, the bracket spring 28 pulls the secondary clevis 25 towards the center of the body 1, while on the other side the tightening of butterfly nut 30 onto the bracket bolt 27 pulls the secondary clevis 25 in a direction away from the center of the body 1. In spite of the above, the secondary clevis 25 may also have unwanted small rotation about the central axis of the bracket bolt 27, the rotation is controlled and minimized by the compressive force of the bracket spring 28. However, in the preferred embodiment, a gap of controlled distance is made between the two ribs extending from the two tubes 1*t* of the body 1, such that one dimension of the secondary clevis 25 is fitted in the gap with some small tolerance. Therefore, the secondary clevis 25 is guided along the gap formed between the ribs of the tubes 1*t* and the unwanted rotation is minimized.

Now, in accordance with the first embodiment detailed in FIGS. 3-4, the operation of clamping the bracket assembly 200 onto a pole 32 can be described. Two holes 24*h* are formed symmetrically on opposing walls of the U shaped primary clevis 24 so that the pole 32 may pass through. The holes 24*h* have a jagged edge on one side to enable better grip to the pole 32. In similar fashion, two holes 25*h* are formed symmetrically on opposing walls of the U shaped secondary clevis 25 where the pole 32 may pass through. The holes 25*h* also have a jagged edge on one side to enable better grip to the pole 32. Now, during installation of the electronic instrument 100 on a pole 32, the butterfly nut 30 is first loosened but not removed from the bracket bolt. The bracket spring 28 pulls the secondary clevis 25 in a direction towards the center of the body 1 until the holes 24*h* and 25*h* of the primary and secondary devises become generally aligned on a shared axis. It is noted that once the butterfly nut 30 is loosened, the secondary clevis 25 position is not very critical since it has somewhat freedom to move in a direction inward or outward from the center of the body 1, and when the pole 32 is inserted into the holes 24*h* and 25*h*, the secondary clevis may adjust its position slightly to allow the pole to pass through. Once the pole is in a fully inserted position passing through both holes 24*h* of the primary clevis, the butterfly nut 30 is tightened. The secondary clevis 25 moves in a direction away from the center of the body 1 and the holes 25*h* engage the pole with strong side force such that the jagged edges of the holes 25*h* are pushed against the pole 32. Therefore, the pole 32 is pushed towards the jagged edges of the holes 24*h* of the primary clevis with strong side force, thus the locking of the electronic percussion instrument 100 on a pole 32 is complete. In similar but reverse manner, the disassembly of the electronic percussion instrument 100 from a pole 32 is operated. First, the butterfly nut 30 is loosened until the side forces between the pole and the holes 24*h* and 25*h* are eliminated, at which point the electronic percussion instrument 100 slides due to the weight thereof down the pole 32. The user can then lift the electronic percussion instrument 100 such that the pole is removed completely from the holes 24*h* of the primary clevis.

Figure 5A:
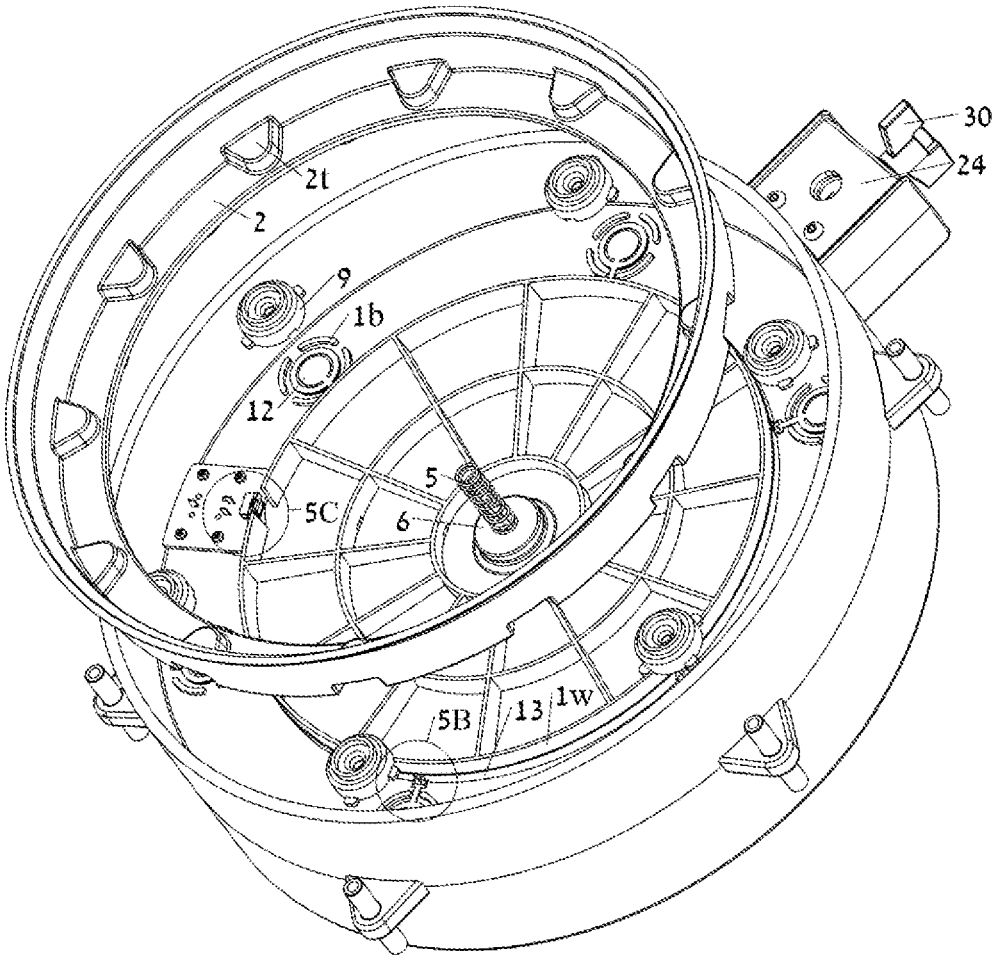
FIG. 5A is a perspective view of FIG. 1, showing the elements relating to sensor assembly and electrical connection of the sensors.
Figure 6:
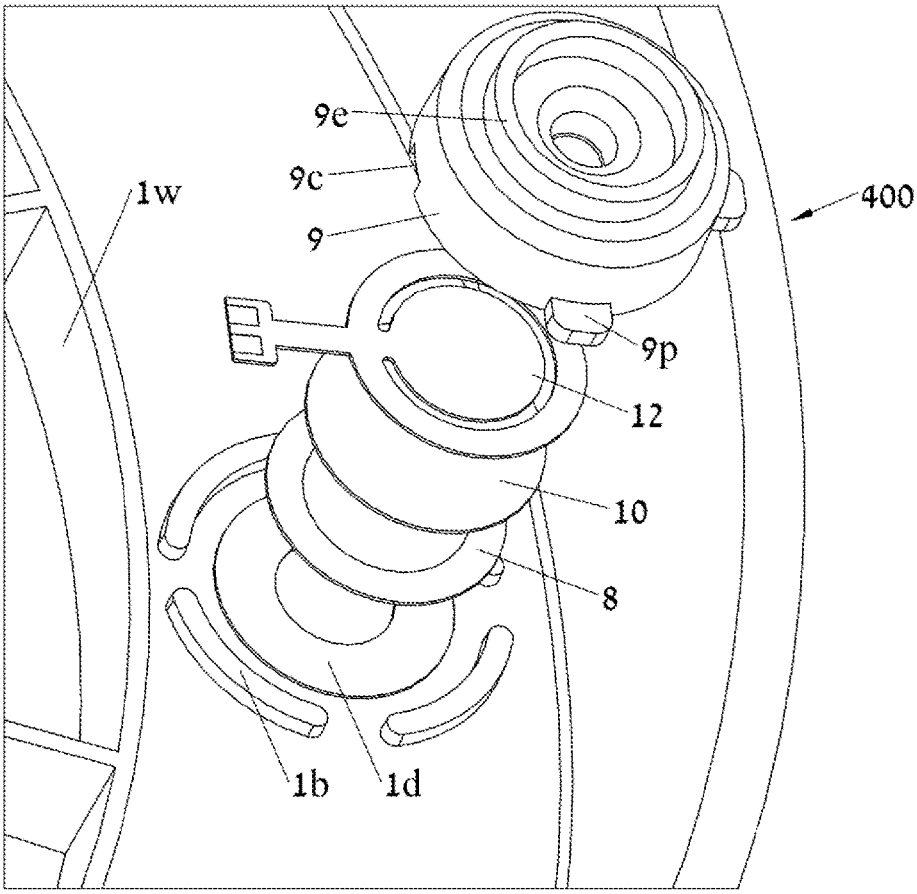
FIG. 6 is a perspective view of the peripheral sensor assembly according to the first embodiment of the invention.

Referring to FIGS. 2A, 2B, 5A and 6, a peripheral carrier 2 and a peripheral sensor assembly 400 are introduced according to the first embodiment. The peripheral carrier 2 is a generally rigid, circular part that it disposed interior to the electronic percussion instrument 100. The peripheral carrier 2 is held in contact with the drumhead 3, abutting its underside with light pressure, thus receiving vibrations from the periphery of the strike-able area of the drumhead 3, close to the top rim 17. Since the peripheral carrier 2 is rigid and is receiving vibrations from plurality of locations on the drumhead 3, it acts as a mechanical filter where small local vibrations received from the top drumhead 3 are suppressed while the stronger vibrations are able to move peripheral carrier 2. A plurality of peripheral sensor assemblies 400 are located under the peripheral carrier 2 for receiving vibrations induced by percussion strikes. The peripheral sensor assembly 400 according to the first embodiment of the invention comprises a rising element 9, a sensor PCB 12, a z-conductive adhesive tape 10 and a peripheral sensor 8. The peripheral carrier 2 is seated on a plurality of rising elements 9, which according to the preferred embodiment are flexible and may be made from rubber or the like. Referring to FIGS. 6 and 2B, the rising elements 9 have a circular extension 9*e* having a ring shape on their top side, while the peripheral carrier 2 has a plurality of circular extensions 2*e* on its bottom side, also having a ring shaped structure seen as cross section. The circular extension 9*e* is configured to fit into the circular extension 2*e*, thus the peripheral carrier 2 is seated onto the plurality of the rising elements 9 with accuracy. Referring to FIG. 5A, a plurality of a triangle shaped 2*t* are formed on the peripheral carrier 2, the purpose of which is to enhance the rigidity of the peripheral carrier 2.

Referring to FIG. 6 of the first embodiment, the rising elements 9 have a generally circular shape with three protrusions 9*p* extending on their bottom side and a small cutaway 9*c* configured to allow space for electrical connection of the peripheral sensor 8. The rising elements 9 are fitted on an internal flat surface of the body 1 using bosses 1*b*. The bosses 1*b* form a generally circular shape designed to accept the circular shape of the rising elements 9. In order to prevent rotation of the rising elements 9, the protrusions 9*p* are designed to be inserted in the spaces between the bosses 1*b*.

Next, a peripheral sensor 8 is located in the interior of each of the rising elements. The peripheral sensor 8, preferably a piezoelectric disc type, is seated on a disc 1*d*, thus the air gap formed under the peripheral sensor 8 allows it to bend properly when receiving and converting vibrations to electronic signal. In the preferred embodiment, the disc 1*d* is formed directly into the body 1 during injection molding process, however in other embodiments it is also possible to have the disc 1*d* separate from the body, for example by disposing a double sided tape in the shape of a disc on a flat surface of the body 1. Furthermore, in the preferred embodiment the peripheral sensor 8 is not attached to the body 1 by means of adhesive or the like since the rising element 9 has an inner circumference with circular shape generally in the same diameter of the diameter of the peripheral sensor 8, keeping it in place. In other embodiments however, it is possible also to secure the peripheral sensor 8 on the body 1 using adhesive tape or the like.

Figure 7A:
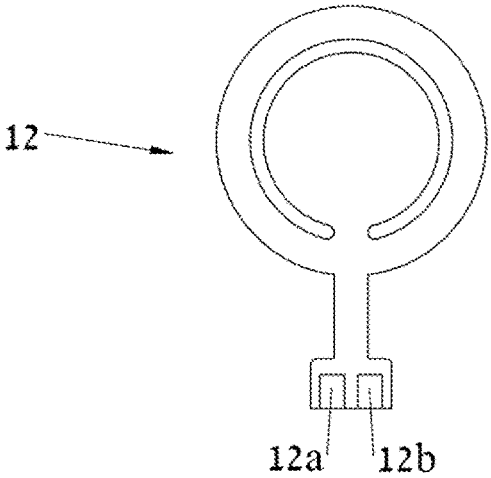
FIGS. 7A and 7B are top and bottom views of the sensor PCB according to the first embodiment of the invention, respectively.
Figure 7B:
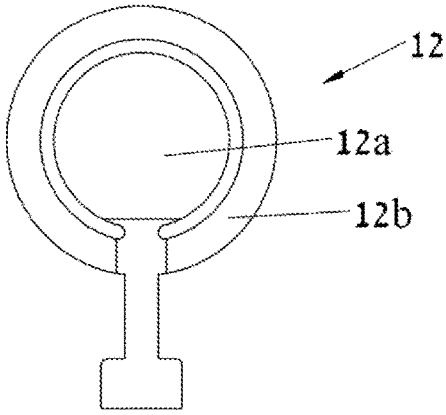

Now, a novel sensor PCB 12 is introduced. The function of the sensor PCB 12 is to replace the two wire electrical connections typically needed for piezoelectric disc type sensors. As the electronic percussion instrument 100 has a plurality of sensors, it becomes increasingly laborious to connect all the sensors wires and also to maintain reliable connections. The sensor PCB 12 according to the first embodiment is shown in FIGS. 7A-7B. FIG. 7A shows the top side of the sensor PCB 12, facing the underside of the rising element 9 while FIG. 7B shows the bottom side of the sensor PCB 12, facing the top side of the peripheral sensor 8. The peripheral sensor assembly 400 according to the first embodiment is shown in FIG. 6. The sensor PCB 12 may be produced by conventional methods for producing circuit boards and is preferable made as a flexible circuit board. The sensor PCB 12 typically has a thin insulating top layer (coverlay) typically made of polyimide film, an internal layer of conductive sheet material such as copper, and a bottom insulating coverlay with same material as the top coverlay. According to the first embodiment, the peripheral sensor 8 is a piezoelectric disc type, having a central portion and a peripheral portion, each requiring an electrical connection for the proper operation. Referring to FIG. 7B, the bottom coverlay is almost completely removed, leaving a central contact 12*a* agreeable in size with the center contact of the peripheral sensor 8, and a peripheral contact 12*b* is agreeable in size with the peripheral portion of the peripheral sensor 8. Therefore the central contact 12*a* and the peripheral contact 12*b* have exposed conductor areas for making suitable electrical contact with the peripheral sensor 8. Still further, referring to FIG. 7A, the central and peripheral contacts 12*a* and 12*b* are brought to the top side of the sensor PCB 12 for electrical connection to the rest of the system as will described hereinbelow. Referring back to FIG. 7B, it is further noted that there is insulation coverlay on the bottom surface of the sensor PCB 12 in the connection area between the center contact 12*a* and the peripheral contact 12*b*, so that the two contacts do not cause unwanted electrical short connection.

According to the first embodiment, a z-conductive adhesive tape 10, having a circular shape in the same diameter as the peripheral sensor 8, is disposed between the top side of the peripheral sensor 8 and the bottom side of the sensor PCB 12. The z-conductive adhesive tape 10 acts as a normal double sided adhesive tape known to the art, however it is also electrically conductive across the thickness of the tape itself ('z-axis'), and not along the length or width of the tape. For this reason, the central and peripheral contacts 12*a* and 12*b* do not make unwanted electrical connection (a short circuit) between each other and are only conductive such that the center portion of the peripheral sensor 8 is in contact to the central contact 12*a* and the periphery portion of the peripheral sensor 8 is in contact with the peripheral contact 12*b*.

Figure 8A:
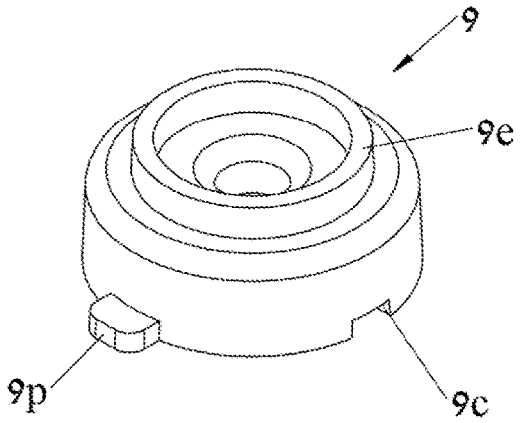
FIGS. 8A and 8B are perspective top and bottom views of the rising element according to the first embodiment of the invention, respectively.
Figure 8B:
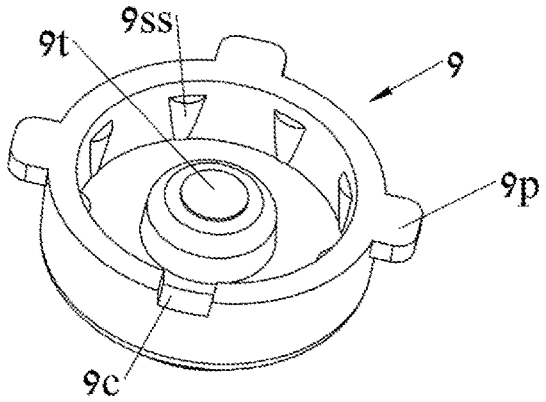

It is noted that the z-conductive adhesive tape 10 can be readily purchased as a roll or die cut into shape. For example, 3M™ electrically conductive adhesive transfer tape 9703 may be used. For the purpose of maintaining a reliable and long lasting electrical connection it is preferable to hold the z-conductive adhesive tape 10 under light pressure. FIGS. 8A and 8B show respectively the rising element 9 perspective top and bottom views in accordance with the first embodiment of the invention. Specifically, a tip 9*t* having a cup shape is formed in the center of the interior of the rising element 9. The tip 9*t* is pressing lightly on the sensor PCB 12 top surface, applying pressure on the z-conductive adhesive tape 10 towards the center of the peripheral sensor 8 and on the central contact 12*a* of the sensor PCB 12. Similarly, a plurality of side seats 9*ss* are arranged circumferentially on internal peripheral wall of the rising element 9. The side seats 9*ss* press lightly on the sensor PCB 12 top surface, applying pressure on the z-conductive adhesive tape 10 towards the peripheral portion of the peripheral sensor 8 and on the peripheral contact 12*b* of the sensor PCB 12. Thus, reliable long lasting electrical connection is ensured since the z-conductive adhesive tape 10 is constantly held under light pressure and does not become loose. It is also noted that it is possible to electrically connect the sensor PCB 12 to the peripheral sensor 8 using methods other than the z-conductive adhesive tape 10. For example, electrically conductive glue may be disposed separately on the center and peripheral portions of the peripheral sensor 8, and, on top the sensor PCB 12 covers the peripheral sensor 8, pressing on the two disposed conductive glue areas to make electrical contacts.

Now, according to the embodiments of the invention, the function of the rising element 9 can be understood in detail. First, a plurality of rising elements 9 is disposed under the peripheral carrier 2. As previously mentioned, the circular extension 9*e* of the rising element 9 is fitted into the circular extension 2*e* of the peripheral carrier 2, securing it into position. Second, the rising elements 9 are made slightly taller in height such that they are pressing the peripheral carrier 2 towards the drumhead 3. Because the drumhead 3 is firmly tightened during normal operation, it presses back against the peripheral carrier 2, and because the peripheral carrier 2 is rigid, the rising elements which are flexible become slightly bent towards the peripheral sensors 8. Thus, the peripheral carrier 2 is lightly pressed at all times against the drumhead 3 as required. Third, the rising elements 9 lightly press against the z-conductive adhesive tape 10 via the tip 9*t* and side seats 9*ss*, ensuring consistent operation and no loss of electrical contact. Finally, the rising elements are disposed interior to the electronic percussion instrument 100 such that they are easily replaceable by a user at a later stage over the product lifetime. As the rising elements are typically made of rubber, it is essential that if the raw material may show signs of fatigue after several years of operation, the electronic percussion instrument could be restored to normal operation without requiring special expertise or service at the factory. Therefore the rising elements 9 are essential for the long life and reliable operation of the invention.

To summarize the above, an electronic percussion instrument is provided, comprising a body 1 having a top opening and an internal support area, referred to in the FIGS. as 1*b*, 1*d* and 1*w*, a top drumhead 3 having a striking surface and a drumhead bottom surface opposite thereto, the top drumhead 3 is stretched over the top opening of the body and is configured to receive a percussion strike thereon, at least one peripheral sensor 8 disposed on the internal support area of the body 1, at least one rising element 9 configured to be flexible and disposed on the internal support area of the body 1, and a peripheral carrier 2, adapted to receiving vibrations from the periphery of the top drumhead 3, the peripheral carrier 2 is supported by the at least one rising element 9 such that a pressing force is formed for setting a top circumferential edge of the peripheral carrier 2 in contact with the top drumhead 3 bottom surface. The at least one peripheral sensor 8 is coupled to the at least one rising element 9 such that vibrations received on the striking surface by a percussion strike are transmitted to the at least one peripheral sensor 8 by the peripheral carrier 2 and the at least one rising element 9.

It is noted that the rising element 9 is preferably made of an elastomeric material such as rubber, and that the rising element 9 is adapted to resume its original shape when a deforming force is removed. However it is noted that the rising element 9 may also be made of foam or configured as a spring having an equivalent function. In any case, the rising element 9 is configured to press the peripheral carrier 2 against the top drumhead 3 bottom surface and further is configured to lightly press the at least one peripheral sensor 8 so as to transmit vibrations from the peripheral carrier 2 to the at least one peripheral sensor 8.

Next, the electrical connection between the peripheral sensors 8 to the main connector 15 is described. As previously mentioned, the electrical connection of multiple sensors can be laborious and it is essential that such connections be made in the most reliable and efficient way possible. The peripheral sensors 8 in the current invention are connected in parallel electrical connection, such that all their central portions are connected together to form only one electronic signal and all their peripheral portions are connected together to form only one other electronic signal, thus in total only two signal lines are output from the plurality of the peripheral sensors 8, forming a output signal representative of a percussion strike relative to a reference signal, usually referred to as ground, or zero volt. This is advantageous since that the number of signals output by the electronic percussion instrument 100 is minimized. The present invention discloses a novel, concrete means for reliable electrical connection of the peripheral sensors 8 that minimize manufacturing labor. As described hereinabove, each peripheral sensor assembly 400 of the first embodiment has a sensor PCB 12, outputting central and peripheral contacts 12*a* and 12*b*, respectively. Now, referring to FIG. 5A-C, a peripheral PCB 13 is introduced. The body 1 is equipped with a wall 1*w* which is extends in circular manner interior to the body 1, and generally reaching near each of the peripheral sensor assemblies 400. Furthermore, the wall 1*w* is standing at close to right angle (to the limit possible by injection molding practices) to the internal surface at which the sensors are located. The peripheral PCB 13 according to the first embodiment is a flexible circuit board which may be manufactured by conventional circuit board factories. The peripheral PCB 13 is introduced on the wall 1*w* such that it is supported and typically adhered to the wall 1*w* by means of glue or by adhesive tape attached to its one side. Two signal leads pass through the peripheral PCB 13 on the copper layer, one for the connection the plurality of central contacts 12*a* and one for the connection the plurality of the peripheral contacts 12*b* from all the sensor PCBs 12. FIG. 5B shows the connection between the sensor PCB 12 and the peripheral PCB 13 according to the first embodiment. A slot is formed in the peripheral PCB 13 such that the sensor PCB 12 can pass through, assisting in the positioning thereof during assembly of a new instrument. Furthermore, two contacts pads are arranged above the slot in the peripheral PCB 13 for each of the sensor PCBs 12, such that once the sensor PCBs 12 is positioned in the appropriate slot of the peripheral PCB 13, the contact pads of the peripheral PCB 13 are adjacent, at about right angle, to the central and peripheral contacts 12*a* and 1*b* of the PCBs 12. On each of the two pairs of contact points, a weld (not shown) is done using a soldering iron and since the positioning is ensured and the contact points may be made large, the weld is strong and can be done easily.

Figure 5C:
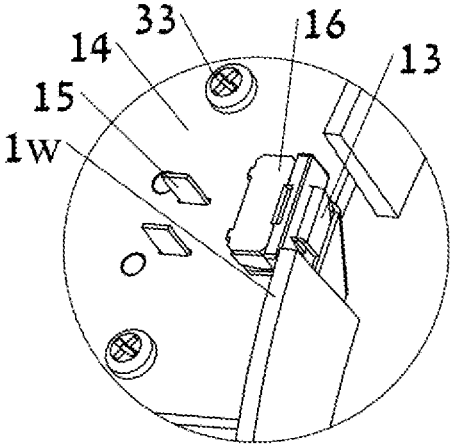
FIG. 5B, 5C are detail views of FIG. 5A.
Figure 5B:
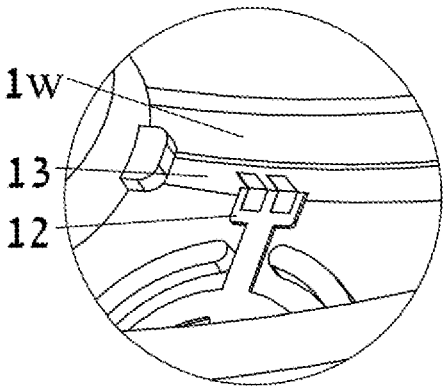

Referring to FIG. 5C, the electrical connection of the peripheral PCB 13 to the main connector 15 is described. The peripheral PCB 13 of the first embodiment is manufactured as a straight, flat piece having the shape of a strip that can be bent at a subsequent stage during assembly of the product. This has the advantage of cost since many such peripheral PCBs 13 can be manufactured together, stacked adjacent to one another as one panel without waste of material. A peripheral connector 16 is attached by solder to a connector PCB 14. The peripheral connector 16 has a narrow opening for receiving so called 'flat cables' and the peripheral PCB 13 has electrical contacts (not shown) made to fit the peripheral connector 16 at the connection area. Since the peripheral PCB 13 is manufactured as a straight piece it is bent such that the contact area thereof can be fitted into the opening of the peripheral connector 16, providing an electrical connection between the plurality of the peripheral sensors 8 to the main connector 15. The length of the peripheral PCB in one dimension is made sufficiently long such that it can be provided close to each of the peripheral sensors 8 when disposed on the wall 1*w* of the internal support area of the body 1. The main connector 15 is attached on the underside of the connector PCB 14 for connection of an external cable (not shown) to the electronic percussion instrument 100, therefore FIG. 5C shows only the metal contacts of the connector protruding through the connector PCB 14. The connector PCB 14 is a standard circuit board, typically a 2 layer board, and is attached to the body 1 using screws 33 that engage the body 1 through holes made into the connector PCB 14.

To summarize, an electronic percussion instrument is provided, comprising a body 1 having a top opening and an internal support area 1*d*, 1*w*, 1*b*, and a top drumhead 3 having a striking surface and a drumhead bottom surface opposite thereto, the top drumhead 3 is stretched over the top opening of the body and is configured to receive a percussion strike thereon, and a peripheral carrier 2, supported interior to the body 1 and having a circumferential top edge configured to be in contact with the top drumhead 3 bottom surface for receiving vibrations from the periphery of the top drumhead 3, and at least one peripheral sensor 8 disposed on the internal support area of the body 1 and coupled to the peripheral carrier 2 for converting vibrations therefrom to an electronic signal, and at least one flexible circuit board, disposed in the internal support area of the body and electrically coupled to the at least one peripheral sensor. The at least one flexible circuit board is configured for reducing electrical wire connections to the at least one peripheral sensor 8, thereby reducing production labor. Furthermore, various options exist for the at least flexible circuit board. As discussed hereinabove, one option would be to use a peripheral PCB 13 configured as a long strip disposed on a circular wall 1*w* of the body 1, this makes possible to provide close electrical connection points close to the peripheral sensors 8. Additionally, for connection from the peripheral PCBs 13 to the peripheral sensors 8 either regular wire attachment may be used, such as welding two wires for each sensor, or sensor PCBs 12 configured as a flexible circuit board may be used to electrically connect the exposed conductors of the peripherals sensor 8 to the peripheral PCB 13. Still further, the peripheral PCB and the plurality of the sensor PCBs 12 may be unified by design of a single a unified PCB 35 as will be show herein below.

Referring to FIGS. 2A and 2C, a central sensor 7 and its related assembly are described according to the first embodiment. The body 1 has an embossed center disk 1*cd* which is a disk shaped raised surface, disposed interior to the electronic percussion instrument 100, centered on an internal surface of the body 1. The purpose of the center disk 1*cd* is to create an air gap under the central sensor 7, to allow bending of the sensor as required for generating electrical signal in response to a mechanical vibration. A double sided tape 11, having circular shape with a diameter the same as the outer diameter of the center disc 1*cd*, is adhered onto the upper surface thereof. The central sensor 7, a piezoelectric disc type, is adhered on top of the double sided tape 11. Another double sided tape 11 is attached on top the central sensor 7. A locating pin 6, typically made of plastic and having a round base the same in diameter as the double sided tape 11 is adhered to the upper surface of the double sided tape. The locating pin 6 has an upward pointing boss for mounting a central carrier 5. The central carrier 5 of the first embodiment is a mechanical spring, which is configured to touch lightly on one side against the bottom surface of the top drumhead 3 and is held in position by the upward pointing boss of the locating pin 6. It is also possible to use other mechanical elements for the central carrier 5, for example, a generally cylindrical or cone shaped part made from flexible material such as foam or soft rubber can also be used.

Not shown in the FIGS. are two wires that connect to the central sensor 7 for outputting an electronic signal in response to vibrations received at the sensor. Referring to FIG. 5C, the wires of the central sensor 7 are connected (not shown) to the connector PCB 14, and output to the main connector 15. The main connector 15 of the first embodiment is of type ¼" TRS and has only three contacts for connections of electrical signals (TRS is an acronym for Tip Ring Sleeve). Since two contacts are needed for the central sensor 7 and two contacts are needed for the aggregated peripheral sensors, which are connected electrically in parallel as discussed hereinabove, total of four signals are needed to be output while only three contacts are available in the main connector 15. The solution is simple, as for each of the two wires needed, one wire may be held at a reference potential and the other wire outputs an electronic signal relative to that reference potential. It does not matter which wire of the pair is selected for the reference potential, the only consequence is a change in the polarity of the output signal. For this reason it is chosen arbitrarily in the current invention to set the disc portion of the piezoelectric sensor of the central sensor 7 to be the reference potential and the center portion thereof is selected for signal output. Similarly, referring to FIG. 7B, the peripheral contacts 12*b* of all the peripheral sensors 8 are also set to the same reference potential. The central contacts 12*a* of all the peripheral sensors 8 are connected together to form a single signal output. In summary, the three signals that are output the main connector 15 are: one shared reference potential between all the disc portions of all the peripheral sensors 8 and the central sensor 7, one signal from the central portion of the central sensor 7, and one signal connected to all the central portions of the peripheral sensors 8. It is noted that one may prefer to set the reference potential to be GND, or ground, of the external so called 'sound module' that connects to the electronic percussion instrument 100, but in fact any reference potential may be set as long as the sound module can detect the signal relative to the reference potential.

Figure 10A:
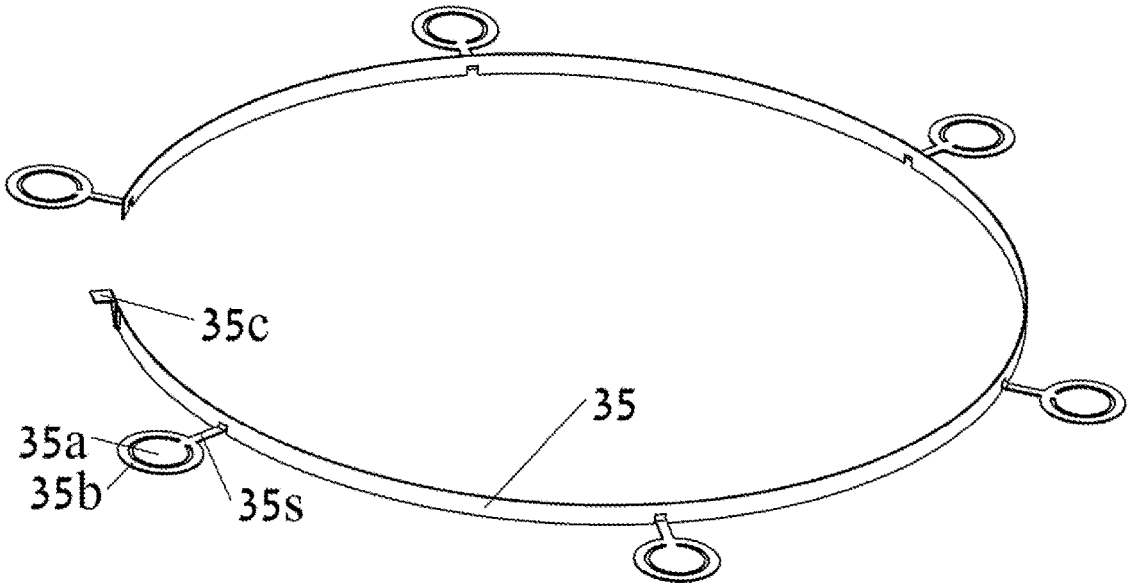
FIG. 10A is a perspective view and of the unified PCB according to the fourth embodiment of the invention.
Figure 10B:
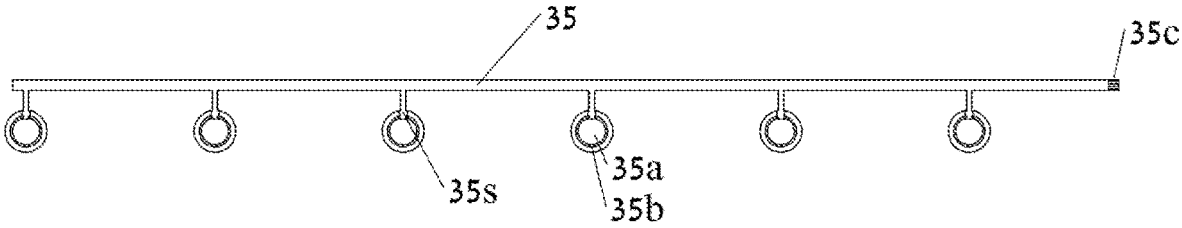
FIG. 10B is a top view and of the unified PCB according to the fourth embodiment of the invention.

Next, a unified PCB 35 is presented in accordance with a fourth embodiment of the invention, as illustrated in FIGS. 10A and 10B. The unified PCB 35 is a flexible circuit board having the advantage of being produced as a single part and is used to electrically connect all the peripheral sensors 8 to the peripheral connector 16 located on the connector PCB 14 in a similar fashion seen in FIG. 5C of the first embodiment. The unified PCB 35 is produced as flat piece, having a top view as illustrated in FIG. 10B (the length of the unified PCB 35 in FIG. 10B. has been somewhat reduced for the sake of better illustration). Since the unified PCB 35 is flexible, it is bent to suit the shape agreeable for fitting into the body 1, seen in the perspective view in FIG. 10A. The assembly into the body 1 is closely resembling the first embodiment of FIG. 5A, however in the fourth embodiment, there are no connection points such as shown in FIG. 5B. The unified PCB 35 has a plurality of sensor areas 35*s*, each having a central contact 35*a* for electrical connection to the center portion of the peripheral sensor 8 (center of the piezoelectric sensor), and a peripheral contact 35*b* for electrical connection to the peripheral portion of the peripheral sensor 8 (the surrounding disc of the piezoelectric sensor). The electrical connection in the fourth embodiment is done using a z-conductive adhesive tape 10, however it may also be done using other methods, such as using a conductive glue or the like. The unified PCB has a connector area 35*c*, suitable for connection to peripheral connector 16.

Comparing the fourth embodiment with the first embodiment, it is seen that the function of the unified PCB 35 is the same as the assembly of the peripheral PCB 13 and the plurality of sensor PCBs 12. However, the manufacturing labor is further minimized in the fourth embodiment because, referring FIG. 5B of the first embodiment, the welding of the plurality of sensor PCBs 12 to the peripheral PCB 13 is completely avoided.

What is claimed is:

1. An electronic percussion instrument, comprising:

a body having a top opening and an internal support area;

a drumhead having a striking surface and a drumhead bottom surface opposite thereto, the drumhead is stretched over the top opening of the body and is configured to receive a percussion strike thereon;

at least one peripheral sensor disposed on the internal support area of the body;

at least one rising element configured to be flexible and disposed on the internal support area of the body; and, a peripheral carrier, configured to receive vibrations from the periphery of the drumhead, the peripheral carrier is supported by the at least one rising element such that a pressing force is formed, setting a top circumferential edge of the peripheral carrier in contact with the drumhead bottom surface, wherein the at least one peripheral sensor is coupled to the at least one rising element such that vibrations received on the striking surface by a percussion strike are transmitted to the at least one peripheral sensor by the peripheral carrier and the at least one rising element.

2. The electronic percussion instrument according to claim 1, wherein the at least one rising element is made of elastomeric material, configured to resume its original shape when a deforming force is removed.

3. The electronic percussion instrument according to claim 1, wherein the at least one rising element is made of foam, configured to resume its original shape when a deforming force is removed.

4. The electronic percussion instrument according to claim 1, wherein the at least one rising element is configured as a spring.

5. The electronic percussion instrument according to claim 1, wherein the at least one rising element is configured to press the peripheral carrier against the drumhead bottom surface and further is configured to lightly press the at least one peripheral sensor so as to transmit vibrations from the peripheral carrier to the at least one peripheral sensor.

6. The electronic percussion instrument according to claim 1, wherein the at least one rising element is having a generally circular shape with a plurality of protrusions extending on the bottom side thereon, such that the at least one rising element is fitted on the internal support area of the body equipped with bosses which are designed to secure the at least one rising element into position.

7. The electronic percussion instrument according to claim 1, wherein an electrical output signal representative of a percussion strike is generated by parallel electrical connection of the peripheral sensors.

8. The electronic percussion instrument according to claim 1 further comprising a unified PCB configured as a flexible circuit board which is produced as a single flat piece and having exposed conductor regions configured to form electrical connection to the at least one peripheral sensor, the unified PCB is bent and attached to the internal support area of the body, reaching each of the peripheral sensors.

9. The electronic percussion instrument according to claim 1 further comprising a peripheral PCB configured as a flexible circuit board which is produced as a flat flexible piece having the shape of a strip but is curved while being supported on the internal support area of the body, wherein the length of the peripheral PCB in one dimension is made sufficiently long and wherein the peripheral PCB is having at least two electronic signals configured to be provided on exposed conductors close to each of the peripheral sensors and electronically coupled thereto.

10. The electronic percussion instrument according to claim 9, further comprising:

at least one sensor PCB configured as a flexible printed circuit board having two electronic signals which have exposed conductor regions configured in a shape similar to the exposed conductors of the at least one peripheral sensor on one end and further having exposed conductors on the other end which are electrically coupled to the peripheral PCB; and, at least one a z-conductive adhesive tape configured to be electrically conductive only in a direction normal to the surface of the least one sensor PCB, the z-conductive adhesive tape is sandwiched between the at least one sensor PCB and the at least one peripheral sensor, providing mechanical attachment and further providing electrical connection by forming two separate electrical connections.

11. The electronic percussion instrument according to claim 9 further comprising wires which provide electrical connection of the at least one peripheral sensor to the peripheral PCB.

12. An electronic percussion instrument, comprising:

a body having a top opening and an internal support area;

a drumhead having a striking surface and a drumhead bottom surface opposite thereto, the drumhead is stretched over the top opening of the body and is configured to receive a percussion strike thereon;

a peripheral carrier, supported interior to the body and having a circumferential top edge configured to be in contact with the drumhead bottom surface such that vibrations are transmitted from the periphery of the drumhead to the peripheral carrier;

at least one peripheral sensor disposed on the internal support area of the body and coupled to the peripheral carrier, converting vibrations therefrom to an electronic signal; and, at least one flexible circuit board, disposed in the internal support area of the body and electrically coupled to the at least one peripheral sensor, wherein the at least one flexible circuit board is configured to reduce production labor by reducing electrical wire connections to the at least one peripheral sensor.

13. The electronic percussion instrument according to claim 12 further comprising at least one rising element made from elastic material and configured to affix the peripheral carrier into position interior to the body such that a pressing force is exerted so as to keep the peripheral carrier in contact with the drumhead bottom surface by slight deformation of the at least one rising element, wherein the at least one rising element is configured to be replaceable.

14. The electronic percussion instrument according to claim 12, wherein the at least one flexible circuit board is configured as a unified PCB produced as a single flat piece and having exposed conductor regions configured to form electrical connection to the at least one peripheral sensor without the use of wires.

15. The electronic percussion instrument according to claim 12, wherein the at least one flexible circuit board is comprising a peripheral PCB which is produced as a flat flexible piece having the shape of a strip but is curved while being supported on the internal support area of the body, wherein the length of the peripheral PCB in one dimension is made sufficiently long and wherein the peripheral PCB is having exposed conductors configured to be provided close to each of the peripheral sensors.

16. The electronic percussion instrument according to claim 15, wherein the at least one flexible circuit board is further comprising at least one sensor PCB having exposed conductor regions which are configured to provide electrical connection to the at least one peripheral sensor from one end and to the peripheral PCB on the other end.

17. The electronic percussion instrument according to claim 15 further comprising wires providing electrical connection of the at least one peripheral sensor to the peripheral PCB.

18. An electronic percussion instrument, comprising:

a body having a top opening, an internal support area and a plurality of protrusions spaced on a middle plane exterior thereof, the protrusions further having a hole;

a top drumhead having a striking surface and a periphery, the top drumhead is stretched over the top opening of the body and is configured to receive a percussion strike thereon;

at least one peripheral sensor disposed on the internal support area of the body;

at least one rising element configured to be flexible and disposed on the internal support area of the body, the at least one rising element is coupled to the periphery of the top drumhead and to the at least one peripheral sensor such that vibrations on the top drumhead are inducing electrical signal on the at least one peripheral sensor, a plurality of lugs, having a hollow shape with an opening on one side and further having a top hole and a bottom hole on other sides, the lugs are configured to cover the protrusions of the body such that the top hole and the bottom hole of the lugs are aligned with the holes of the protrusions;

a top rim, configured as a circular hoop extending over the periphery of the top drumhead and having holes which are aligned about the same axis with the holes of the protrusions and the holes of the lugs;

a plurality of lug top fasteners having a male thread extending on one end and a female thread bored on other end opposite thereto, the lug top fasteners are disposed such that the male thread is inserted through the top and bottom holes of the lug and through the hole of the protrusion;

a plurality of lug bottom fasteners having a generally tubular shape having a female thread throughout the center hole of the tube, the lug bottom fasteners are bolted over the male thread of the lug top fasteners so as to lock the lug top fasteners into position and further affix the lugs into position on the protrusions of the body; and, a plurality of drum bolts, fitted into the holes of the top rim and engaged into the threads of the lug top fasteners so as to exert forces throughout the periphery of the top drumhead in a direction towards the lug top fasteners, holding the top drumhead in a tensioned state.

19. The electronic percussion instrument according to claim 18 further comprising:

a bottom drumhead having a periphery, the bottom drumhead is stretched over a bottom opening of the body; and, a bottom rim, configured as a circular hoop extending over the periphery of the bottom drumhead and having holes which are aligned about the same axis with the threads of the lug bottom fasteners, wherein a plurality of drum bolts are fitted into the holes of the bottom rim and engaged into the female threads of the lug bottom fasteners so as to exert forces throughout the periphery of the bottom drumhead in a direction towards the lug bottom fasteners, the forces are configured to holding the bottom drumhead in a tensioned state and provide an opposing balancing force to the load exerted on the body by the lug top fasteners and lug bottom fasteners.

20. The electronic percussion instrument according to claim 19 further comprising spacers having a tubular shape and made of flexible material, the spacers are disposed between the lug top fasteners and their mating lugs and between the lug bottom fasteners and their mating lugs, wherein the flexibility of the spacers is configured to provide compression and expansion thereof such that the load exerted on the protrusions of the body is reduced.

21. The electronic percussion instrument according to claim 19 wherein a space is formed between the lug top fasteners and their mating lugs and between the lug bottom fasteners and their mating lugs, wherein the spaces formed is configured to provide freedom in movement upward and downward of the lug top fasteners and the lug bottom fasteners such that the load exerted on the protrusions of the body is eliminated.

* * * * *